US006213013B1

(12) United States Patent
Sunako

(10) Patent No.: US 6,213,013 B1
(45) Date of Patent: Apr. 10, 2001

(54) SKIPPING PRINTER DRIVING METHOD

(75) Inventor: Kazuyuki Sunako, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/317,628

(22) Filed: May 25, 1999

(30) Foreign Application Priority Data

May 26, 1998 (JP) ..... 10-144216

(51) Int. Cl.[7] ..... B41J 3/00

(52) U.S. Cl. ..... 101/93.04; 400/76; 400/70; 400/61

(58) Field of Search ..... 400/76, 70, 61; 101/93.04

(56) References Cited

U.S. PATENT DOCUMENTS 4,386,563 * 6/1983 Farb ..... 101/93.04
4,550,659 * 11/1985 Yamanaga ..... 101/93.04
5,263,782 * 11/1993 Yageta et al. ..... 400/121

FOREIGN PATENT DOCUMENTS 61-35970 2/1986 (JP) .
62-66945 3/1987 (JP) .
2-172760 7/1990 (JP) .
8-174910 7/1996 (JP) .
11-188925 7/1999 (JP) .

* cited by examiner

*Primary Examiner*—John S. Hilten
*Assistant Examiner*—Charles H. Nolan, Jr.
(74) *Attorney, Agent, or Firm*—Foley & Lardner

(57) ABSTRACT

A skipping (draft) printer driving method is proposed for a line dot printer whose head bank (which executes shuttle action in a direction perpendicular to the paper feed direction) is provided with printing pins which are arranged in the shape of saw blade. In the saw blade printing pin arrangement, a printing pin group having L (L: 2, 3, 4, . . .) printing pins for executing dot printing for 1st through L-th dot printing rows respectively is repeated in a direction perpendicular to the paper feed direction. According to the skipping printer driving method, on each stroke (a to-action or a fro-action) of the head bank, one or more printing pins selected from the L printing pins of the printing pin group are assigned to execute dot printing during the stroke, and the printing pins that have been assigned to execute dot printing during the stroke are driven by a driving circuit of the line dot printer during the stroke so as to execute dot printing of part of a desired dot pattern to be printed on paper. For example, the printing pins are driven so that one or more selected dot printing rows in the 1st through L-th dot printing rows will be printed in each stroke of the head bank. By such skipping printer driving method, the characteristics of the head bank can be improved, and the load on the driving circuit and the noise level can be reduced.

7 Claims, 10 Drawing Sheets

SKIPPING PRINTER DRIVING METHOD

BACKGROUND OF THE INVENTION

The present invention relates to a skipping (draft) printer driving method, and in particular, to a skipping printer driving method for a line dot printer which is provided with dot printing elements (pins) which are arranged in the shape of a saw blade in a direction perpendicular to the paper feed direction.

DESCRIPTION OF THE PRIOR ART

FIG. 1 is a perspective view showing an example of a line dot impact printer, and FIG. 2 is a schematic diagram showing an example of an arrangement of printing pins of the line dot impact printer of FIG. 1. Referring to FIG. 1, paper 104 is placed between a platen 103 and an ink ribbon 102. A hammer bank 101 which is placed parallel to the platen 103 swings in a direction parallel to the platen 103 (in a direction perpendicular to the paper feed direction). In other words, the hammer bank 101 moves a little to the direction of the arrow P which is shown in FIG. 1 and moves back a little to the direction of the arrow Q.

Referring to FIG. 2, the hammer bank 101 is provided with a plurality of hammer springs 105, and each hammer spring 105 is provided with a printing pin 106 on its tip. The printing pins 106 are arranged in the shape of a saw blade. In other words, from left to right in FIG. 2, the length of the hammer springs 105 gradually increases by a predetermined length, returns to the first length, and thereafter repeats the variation. Such arrangement of the printing pins 106 is employed for increasing printing speed and printing dot density, and decreasing printing time and the heating value of the hammer bank 101. The printing pins 106 provided on the tips of the hammer springs 105 of the hammer bank 101 hits the ink ribbon 102 on the paper 104 on the platen 103, and thereby dot impact printing is executed.

In the following, conventional printer driving methods for driving printing pins (printing hammers) of line dot impact printers of a conventional type will be described referring to FIG. 3 through FIG. 10.

FIG. 3 is a schematic diagram showing part of a conventional line dot impact printer in which a conventional printer driving method is employed. Referring to FIG. 3, the conventional line dot impact printer is provided with a head bank 1 which is placed in a direction A–A' parallel to a platen (in a direction A–A' perpendicular to the paper feed direction). The head bank 1 is provided with a plurality of printing hammers Di (printing elements Di) which are arranged at predetermined intervals C in the direction A–A'. The head bank 1 is supported and guided in the direction A–A' by rails 3*a* and 3*b*, and is moved by an off centered disk 2 in the direction A–A'. The printing hammers Di are selectively driven at their predetermined dot positions respectively while the head bank 1 is shuttled back and forth in the direction A–A' by the decentered disk 2.

FIG. 4 is a schematic diagram showing the movement of the printing hammers Di (i=1~4, for brevity) on the shuttled head bank 1. Incidentally, while the printing hammers D2 and D4 are drawn in FIG. 4 lower than the printing hammers D1 and D3 for the sake of explanation and clear drawing, the printing hammers D1~D4 are placed in line as have been shown in FIG. 3. In FIG. 4, "E1"~"E4" indicate printing areas of the printing hammers D1~D4 respectively, and each printing area includes 6 dot positions in this example. Each printing hammer D1~D4 makes back-and-forth movements in the direction A–A' as the head bank 1 moves, and the paper is moved by 1 dot in the paper feed direction when the head bank 1 reached the ends (the right-hand end and the left hand end) of the shuttle action. Therefore, the printing hammers D1~D4 move on the paper along the lines shown in FIG. 4, during which each printing hammer D1~D4 prints dots on the paper at the predetermined dot positions (aij, bij, cij or dij) which are arranged at predetermined intervals P. Broken circles in FIG.4 are showing a moment at which the printing hammers D1~D4 are at the dot positions a32, b32, c32 and d32 respectively.

FIG. 5 is a circuit diagram showing a driving circuit for driving the printing hammers D1~D4 of the conventional line dot impact printer of FIG. 3 and FIG. 4. The driving circuit of FIG. 5 includes solenoids 4~7, pairs of switching transistors (16, 17), (18, 19), (20, 21) and (22, 23), diodes 24~31, transistors 9 and 10, terminals 8, 11, 12, 13 and 14, etc. The solenoids 4~7 are provided in order to drive each of the printing hammers D1~D4. Excitation of the solenoids 4~7 is controlled by a print driving pulse F and print instruction signals (print control pulses) G1~G4 which are shown in FIG. 5. A position detection signal is outputted by a rotary encoder etc. by detecting the movement of the head bank 1, and the print driving pulse F is generated based on the position detection signal. The print driving pulse F is supplied to the terminal 8 when the printing hammers D1~D4 reached dot positions (printing positions), thereby, the transistor 9 is turned on and the transistor 10 is turned on, and thereby the solenoids 4~7 are supplied with print driving voltages V. The print control pulses G1~G4 are generated substantially in synchronization with the print driving pulse F, and the print control pulses G1~G4, having levels "1" or "0" according to a dot pattern outputted by a character generator, are supplied to the terminals 11~14, and thereby the solenoids 4~7 are excited selectively.

FIG. 6 is a timing chart showing an example of timing of the print control pulses (print instruction signals) G1~G4. Dotted lines shown in FIG. 6 indicate the print instruction signals of the level "0" so as not to print dots on the paper (i.e. so as not to excite corresponding solenoids 4~7). Incidentally, in FIG. 5, the switching transistors (16, 17) (18, 19) (20, 21), and (22, 23) are connected in Darlington connection for obtaining a large current amplification factor. The diodes 24~27 are provided in order to protect the switching transistors (16, 17), (18, 19), (20, 21) and (22, 23), respectively. The diodes 28–31 is provided in order to form a closed circuit with the solenoid 4 and pass a loop current when the print control pulse G1–G4 fall to "0", (see Japanese Patent Application Laid-Open No.SHO61-35970, for example).

In the above printer driving method shown in FIGS. 4 and 6, all the printing hammers D1~D4 are driven at the same instant when solidly shaded (black) patterns are printed on the paper, therefore, large momentary power consumption occurs in the driving circuit, and thus power consumption efficiency of the driving circuit is necessitated to be low. Further the noise level of the line dot impact printer is necessitated to be considerably high.

FIG. 7 is a schematic diagram showing another example of the movement of printing hammers Hi (i=1~4, for brevity) on the head bank 1 of the conventional line dot impact printer of FIG. 3. The printer driving method shown in FIG. 7 has been disclosed in Japanese Patent Application Laid-Open No. SHO61-35970. Also in this example, the printing hammers H1~H4 are placed in line as in FIG. 3, although the printing hammers H2 and H4 are drawn in FIG. 7 lower than the printing hammers H1 and H3 for the sake of explanation and clear drawing. Similarly to the case of FIG. 4, symbols "E1"~"E4" in FIG. 7 indicate printing areas of the printing hammers H1~H4 respectively, and each printing area includes 6 dot positions. Each printing hammer H1~H4 makes back-and-forth movements in the direction A–A' as the head bank 1 moves, and the paper is moved by 1 dot in the paper feed direction on the ends (the right-hand end and the left-hand end) of the shuttle action of the head bank 1, and thus the printing hammers H1~H4 move on the paper along the lines shown in FIG. 7, during which each printing hammer H1~H4 prints dots on the paper at predetermined dot positions (aij, bij, cij or dij) which are arranged at predetermined intervals P.

FIG. 8 shows timing of print control pulses (print instruction signals) J1~J4 for driving the printing hammers H1~H4 of FIG. 7. Referring to FIG. 8, the print control pulses J1 and J3 (for driving the printing hammers H1 and H3) are generated in phase with each other, and the print control pulses J2 and J4 (for driving the printing hammers H2 and H4) are generated out of phase with the print control pulses J1 and J3 by T/2. Therefore, odd number hammers (H1, H3, . . . ) and even number hammers (H2, H4, . . . ) are driven alternately as the head bank 1 moves in the direction A–A'. Broken circles in FIG. 7 are showing a moment at which the printing hammers H2 and H4 are at dot positions and the printing hammers H1 and H3 are in between dot positions.

FIG. 9 is a circuit diagram showing a driving circuit for driving the printing hammers H1~H4 of FIG. 7, and FIG. 10 is a schematic diagram showing the arrangement of the printing hammers H1~H4. As shown in FIG. 10, the positions of the even number hammers (H2, H4, . . . ) are shifted by P/2 so as to suit the alternate hammer driving. Referring to FIG. 9, the driving circuit includes a position detector 20, a position timing pulse generator 22, a movement direction detector 24, a controller 26, switches 28 and 36, delay circuits 32 and 40, odd number hammer driver 34, and even number hammer driver 42. The position detector 20 detects the position of the head bank 1 and thereby outputs a position detection signal, and the movement direction detector 24 detects the direction of the movement of the head bank 1 and thereby outputs a direction detection signal. The position timing pulse generator 22 generates position timing pulse signals according to the position detection signal outputted by the position detector 20. The controller 26 controls the switches 28 and 36 depending on the direction detection signal outputted by the movement direction detector 24, and thereby delays the position timing pulse signals that are supplied to the odd number hammer driver 34 or the position timing pulse signals that are supplied to the even number hammer driver 42. The statuses of the switches 28 and 36 in FIG. 9 show a half cycle of the shuttle action of the head bank 1 during which the position timing pulse signals that are supplied to the even number hammer driver 42 are delayed by T/2 and those that are supplied to the odd number hammer driver 34 are not delayed.

In the second printer driving method shown in FIGS. 7 through 10, alternate hammer driving (repetition of odd number hammer driving and even number hammer driving) is executed in a stroke (a forward action or a backward action) of the head bank 1. Therefore, momentary power consumption in the driving circuit is reduced to half, and thus power consumption efficiency of the driving circuit is improved. Further, the noise level of the line dot impact printer can be reduced considerably.

FIG. 11 and FIG. 12 are schematic diagrams showing the operation of the line dot impact printer of FIGS. 1 and 2 which is provided with the aforementioned saw blade printing pin arrangement. In other words, FIG. 11 and FIG. 12 show a conventional skipping printer driving method for the line dot impact printer of FIGS. 1 and 2. A group of printing pins 106 (4 printing pins in the example of FIG. 11) execute dot printing for their printing area while the hammer bank 101 executes one shuttle action (back-and-forth action). Therefore, the printing pins 106 execute skip (draft) printing in the forward action and in the backward action. In the case where a solidly shaded (black) pattern is printed on the paper, the printing pins 106 are driven simultaneously so as to repeat printing dots and skipping dots as shown in FIG. 11, during the forward action of the hammer bank 101. During the backward action which is shown in FIG. 12, the printing pins 106 are driven simultaneously so as to execute printing for the dots that have been skipped in the forward action of the hammer bank 101.

However, in the conventional skipping printer driving method of FIGS. 11 and 12, all the printing pins 106 are driven at the same instant both in the forward action and in the backward action. Therefore, magnetic interference occurs between adjacent printing pins 106 to a considerable level, and thereby the impact of the printing pins 106 against the ink ribbon 102 and the paper 104 is lowered, and the characteristics of the hammer bank 101 such as driving frequency etc. are necessitated to be deteriorated.

SUMMARY OF THE INVENTION

It is therefore the primary object of the present invention to provide a skipping printer driving method for a line dot printer which is provided with printing pins which are arranged in the shape of a saw blade in a direction perpendicular to the paper feed direction, by which magnetic interference between the printing pins can be reduced and thereby deterioration of the characteristics of the hammer bank (head bank) can be avoided.

In accordance with a first aspect of the present invention, there is provided a skipping (draft) printer driving method for a line dot printer whose head bank, which executes shuttle action in a direction perpendicular to the paper feed direction, is provided with printing pins which are arranged in the shape of a saw blade. In the saw blade arrangement, a printing pin group having L (L: 2, 3, 4, . . . ) printing pins for executing dot printing for the 1st through the L-th dot printing rows, respectively, is repeated in a direction perpendicular to the paper feed direction. According to the skipping printer driving method, on each stroke (a forward action or a backward action) of the head bank, one or more printing pins selected from the L printing pins of the printing pin group is assigned to execute dot printing during the stroke. The printing pins that have been assigned to execute dot printing during the stroke are driven by a driving circuit of the line dot printer during the stroke so as to execute dot printing of part of a desired dot pattern to be printed on paper.

In accordance with a second aspect of the present invention, the printing pins in the printing pin groups are driven by the driving circuit so that one or more selected dot printing rows in the 1st through the L-th dot printing rows will be printed in each stroke of the head bank.

In accordance with a third aspect of the present invention, the printing pins in the printing pin groups are driven by the driving circuit, according to the number classes modulo 2 with respect to the printing pin number M (M: 1, 2, . . . , L) of the printing pins in the printing pin groups.

In accordance with a fourth aspect of the present invention, the printing pins in the printing pin groups are driven by the driving circuit, according to the number classes modulo 3 with respect to the printing pin number M (M: 1, 2, . . . , L) of the printing pins in the printing pin groups.

In accordance with a fifth aspect of the present invention, the printing pins in the printing pin groups are driven by the driving circuit, according to the number classes modulo 4 with respect to the printing pin number M (M: 1, 2, . . . , L) of the printing pins in the printing pin groups.

In accordance with a sixth aspect of the present invention, the printing pins of the head bank of the line dot printer execute dot impact printing on paper using an ink ribbon.

In accordance with a seventh aspect of the present invention, the printing pins of the head bank of the line dot printer execute dot thermal printing on heat-sensitive paper.

BRIEF DESCRIPTION OF THE DRAWINGS

The objects and features of the present invention will become more apparent from the consideration of the following detailed description taken in conjunction with the accompanying drawings, in which:

FIGS. 11 and 12 are schematic diagrams showing a conventional skipping printer driving method for the line dot impact printer of FIGS. 1 and 2, in which FIG. 11 shows the operation of the printing pins during a forward-action of a hammer bank of the line dot impact printer, and FIG. 12 shows the operation of the printing pins during a backward-action of the hammer bank;

FIGS. 15A and 15B are schematic diagrams showing a skipping printer driving method according to a first embodiment of the present invention, in which FIG. 15A shows dot impact printing by the printing pins during a forward-action of a hammer bank of the line dot impact printer of FIG. 13, and FIG. 15B shows dot impact printing by the printing pins during a backward-action of the hammer bank; and FIGS. 16A through 16C are schematic diagrams showing a skipping printer driving method according to a second embodiment of the present invention, in which FIG. 16A shows dot impact printing by the printing pins during the first forward-action of the hammer bank, FIG. 16B shows dot impact printing by the printing pins during the first backward-action of the hammer bank, and FIG. 16C shows dot impact printing by the printing pins during the second forward-action of the hammer bank.

DESCRIPTION OF THE PREFERRED EMBODIMENTS

Figure 1:
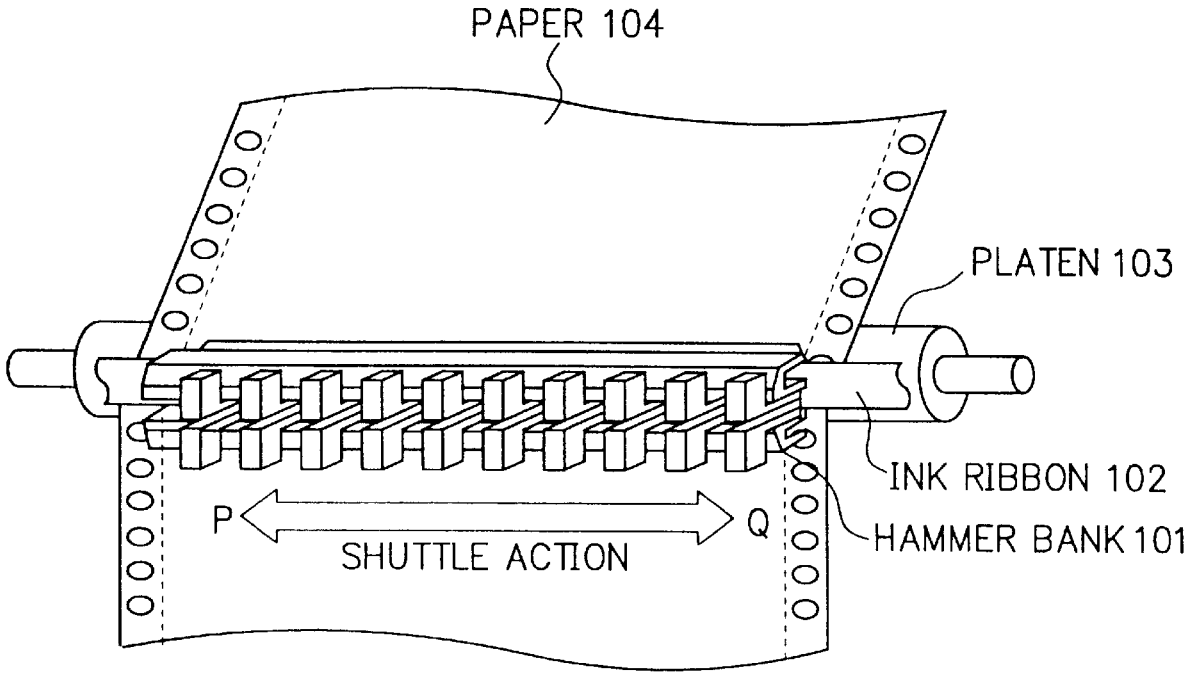
FIG. 1 PRIOR ART
FIG. 1 is a perspective view showing an example of a line dot impact printer.

Referring now to the drawings, a description will be given in detail of preferred embodiments in accordance with the present invention.

Figure 2:
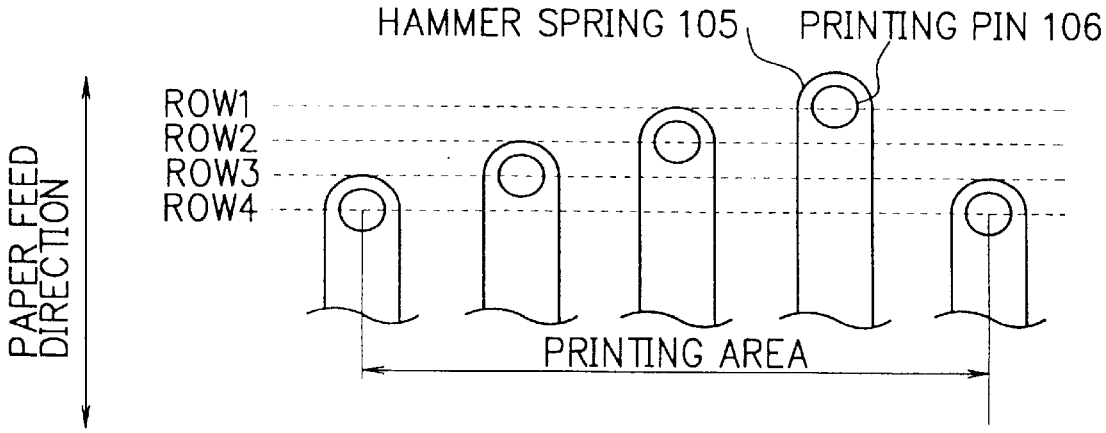
FIG. 2 PRIOR ART
FIG. 2 is a schematic diagram showing an example of an arrangement of printing pins (saw blade printing pin arrangement) of the line dot impact printer of FIG. 1.
Figure 3:
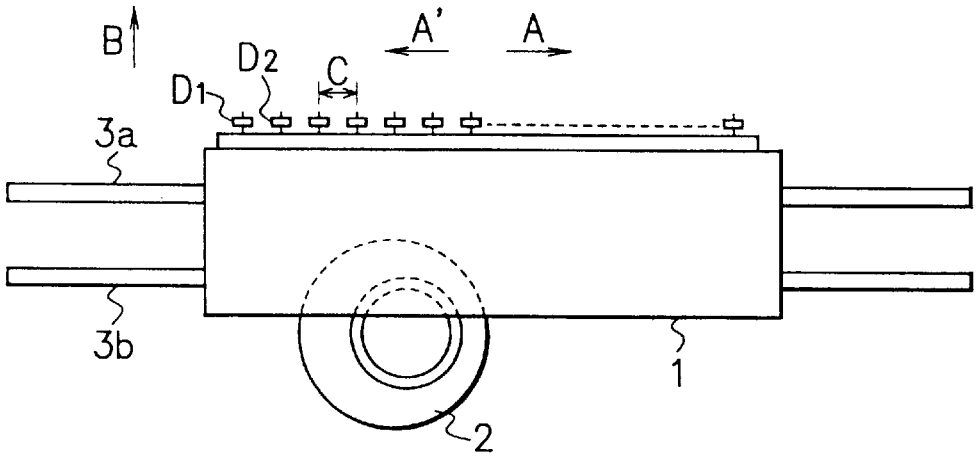
FIG. 3 PRIOR ART
FIG. 3 is a schematic diagram showing part of a conventional line dot impact printer in which a conventional printer driving method is employed.
Figure 4:
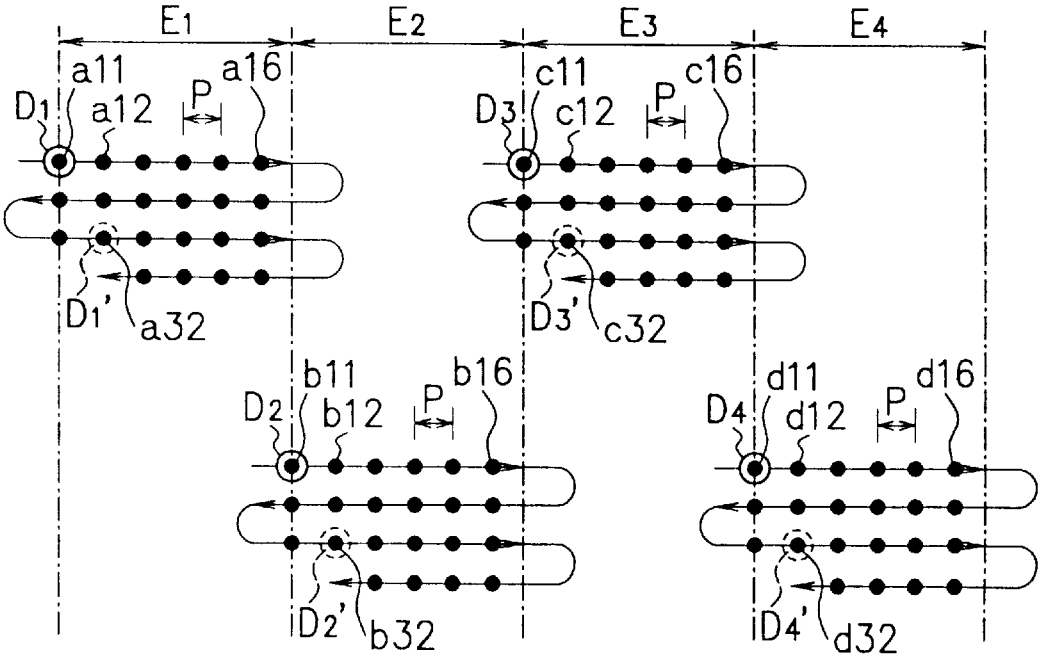
FIG. 4 PRIOR ART
FIG. 4 is a schematic diagram showing the movement of printing hammers on a head bank of the conventional line dot impact printer of FIG. 3.
Figure 5:
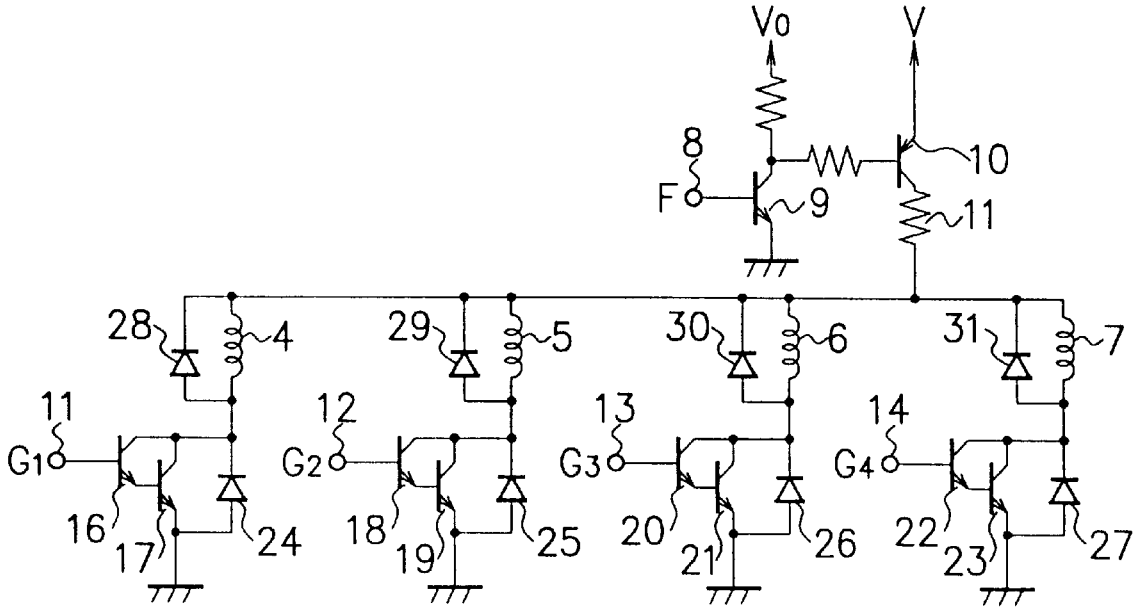
FIG. 5 PRIOR ART
FIG. 5 is a circuit diagram showing a driving circuit for driving the printing hammers of the conventional line dot impact printer of FIGS. 3 and 4.
Figure 6:
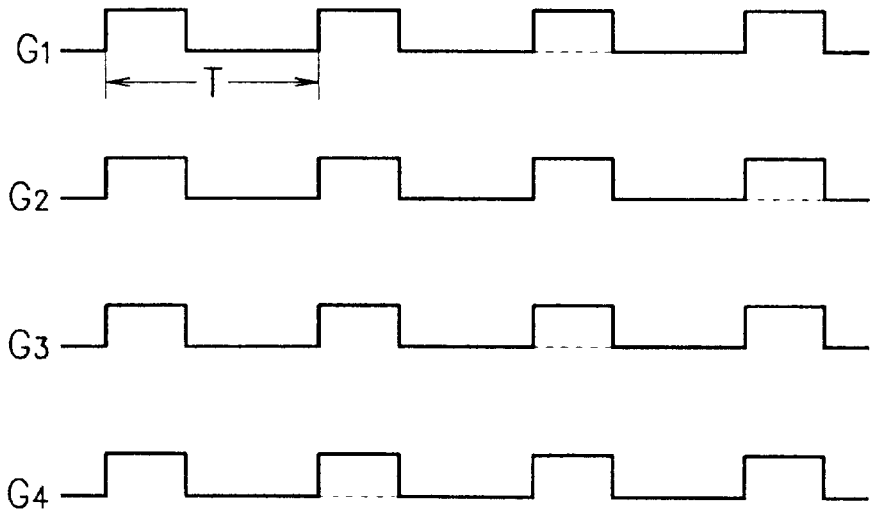
FIG. 6 PRIOR ART
FIG. 6 is a timing chart showing an example of timing of print control pulses (print instruction signals) which are shown in FIG. 5.
Figure 7:
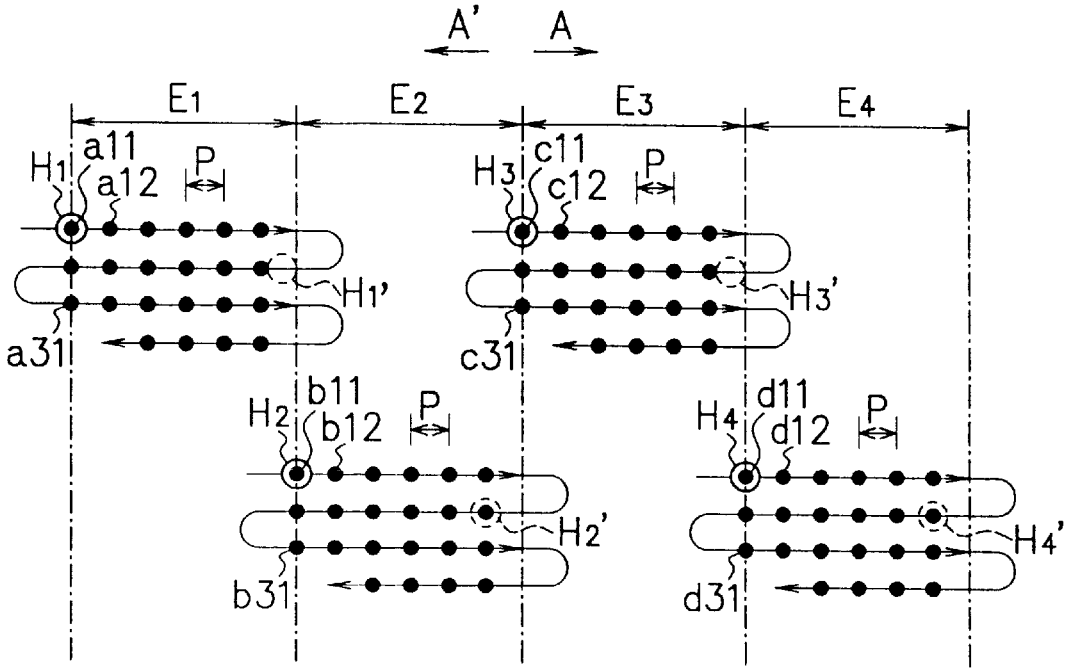
FIG. 7 PRIOR ART
FIG. 7 is a schematic diagram showing another example of the movement of printing hammers on the head bank of the conventional line dot impact printer of FIG. 3.
Figure 8:
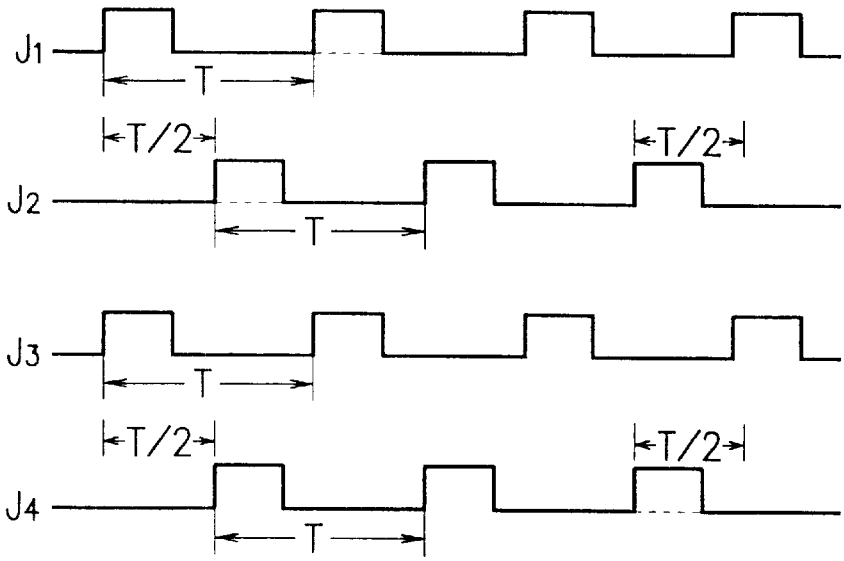
FIG. 8 PRIOR ART
FIG. 8 is a timing chart showing timing of print control pulses (print instruction signals) for driving the printing hammers which are shown in FIG. 7.
Figure 9:
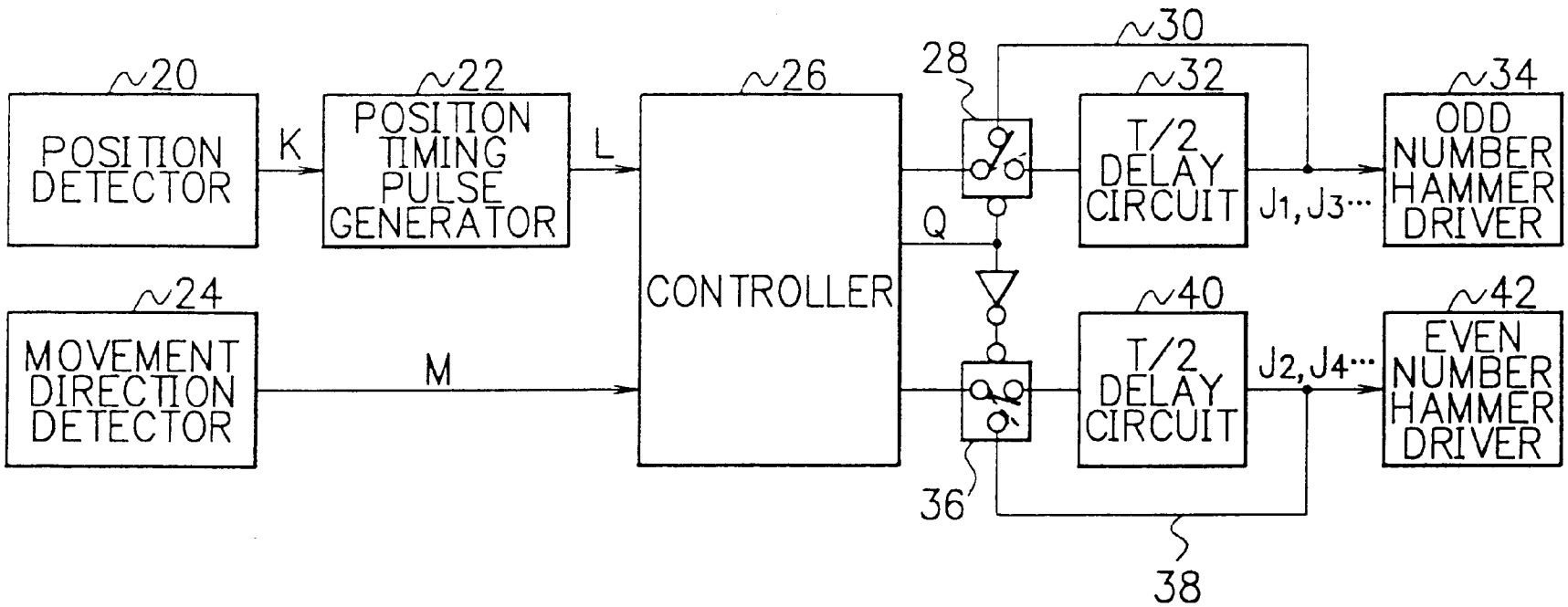
FIG. 9 PRIOR ART
FIG. 9 is a circuit diagram showing a driving circuit for driving the printing hammers shown in FIG. 7.
Figure 10:
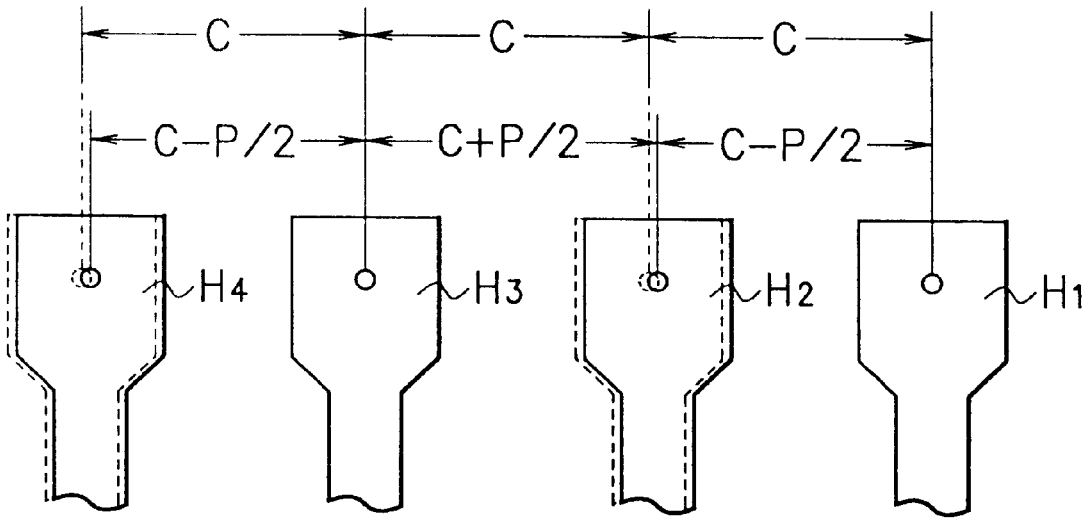
FIG. 10 PRIOR ART
FIG. 10 is a schematic diagram showing the arrangement of the printing hammers shown in FIG. 7.
Figure 11:
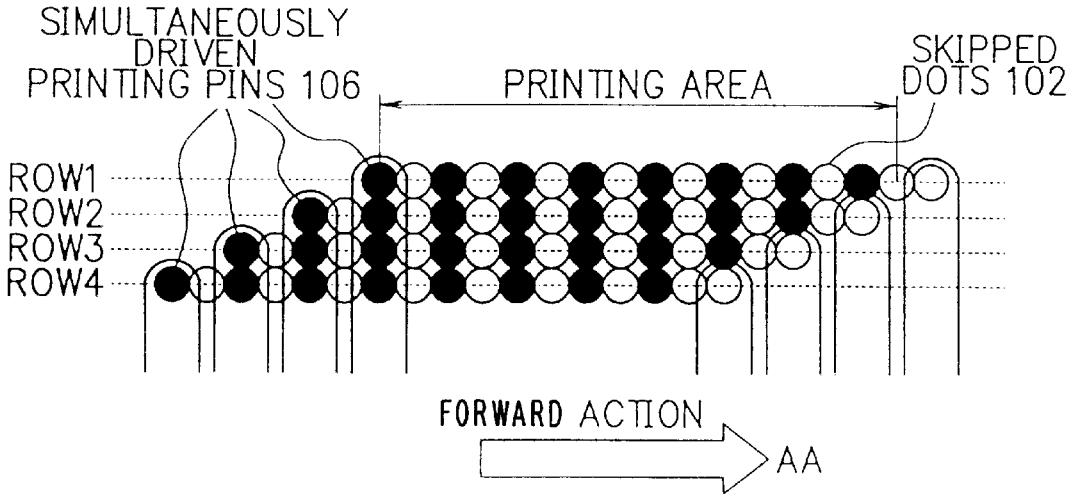
FIG. 11 PRIOR ART
Figure 12:
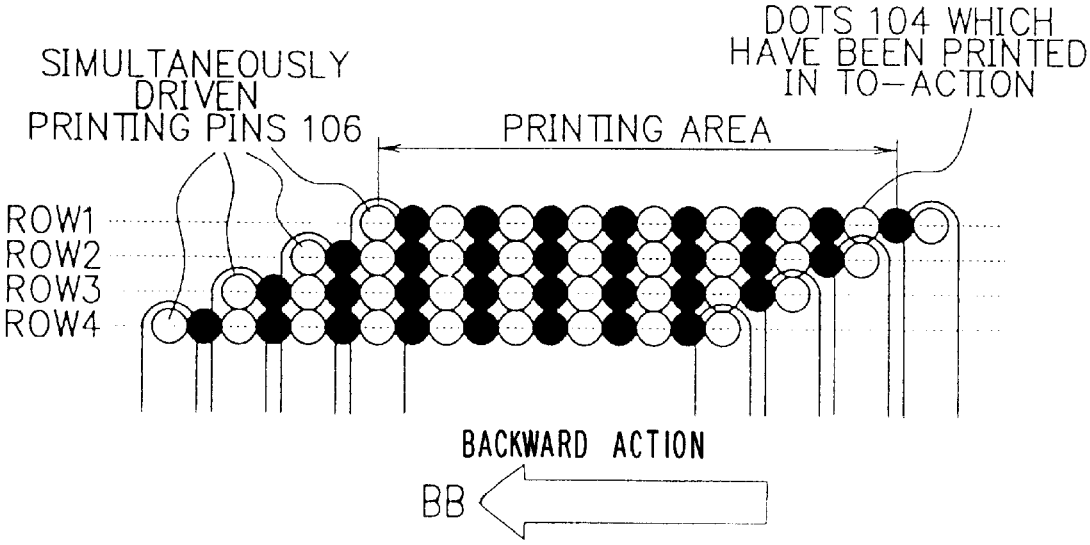
FIG. 12 PRIOR ART
Figure 13:
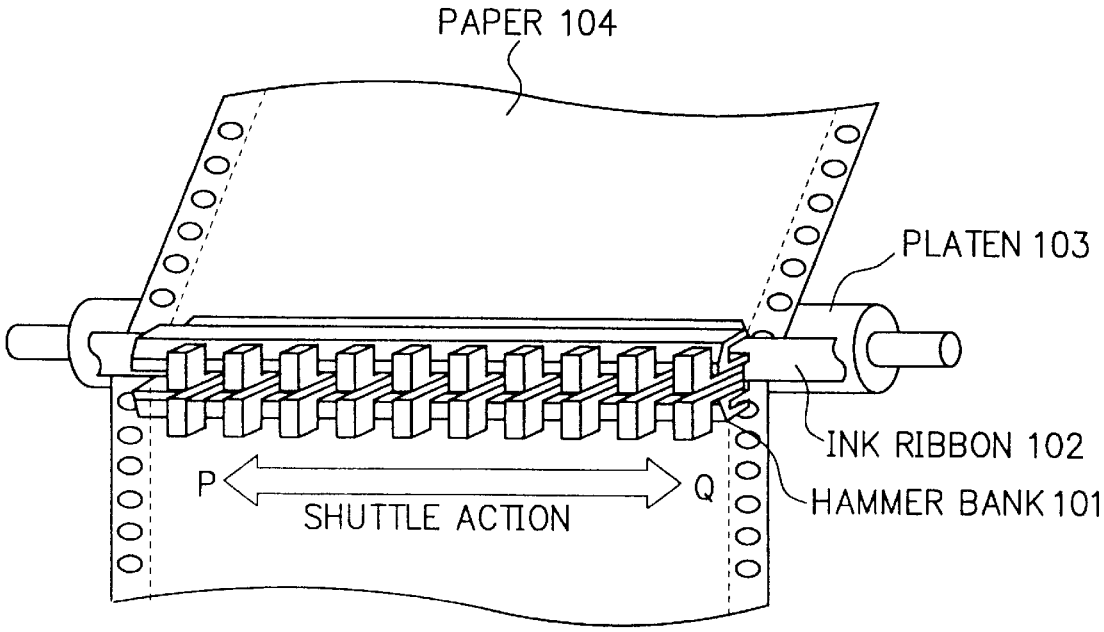
FIG. 13 is a perspective view of part of a line dot impact printer in which a skipping printer driving method according to the present invention is employed.
Figure 14:
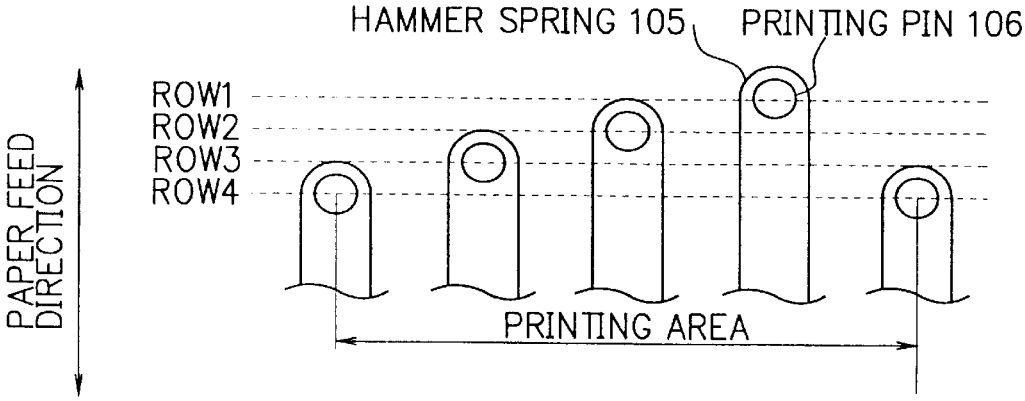
FIG. 14 is a schematic diagram showing an example of an arrangement of printing pins (saw blade printing pin arrangement) of the line dot impact printer of FIG. 13.

FIG. 13 is a perspective view of part of a line dot impact printer in which a skipping printer driving method according to the present invention is employed, and FIG. 14 is a schematic diagram showing an example of arrangement of printing pins of the line dot impact printer of FIG. 13. Incidentally, FIGS. 13 and 14 are the same as FIGS. 1 and 2 which have been referred to in the "Description of the Prior Art".

Referring to FIGS. 13 and 14, a hammer bank 101 which is provided with hammer springs 105 and printing pins 106 executes shuttle action (back-and-forth action) in a direction perpendicular to the paper feed direction. Paper 104 which is placed between an ink ribbon 102 and platen 103 is held at a standstill by the platen 103 during every stroke (a forward-action or a backward-action) of the hammer bank 101, and is moved by the platen 103 by a predetermined number of dots in the paper feed direction at the end of every shuttle action. During the shuttle action, the printing pins 106 hit the ink ribbon 102 on the paper 104 on the platen 103, and thereby dot impact printing on the paper 104 is executed.

Referring to FIG. 14, the hammer bank 101 is provided with a plurality of hammer springs 105 each of which is provided with a printing pin 106 on its tip. The printing pin 106 is fixed to the tip of the hammer spring 105 by crimping, brazing, etc. The length of the hammer springs 105 gradually increases by a predetermined length, returns to the first length, and thereafter repeats the variation, and thus the printing pins 106 are arranged in the shape of a saw blade in the direction perpendicular to the paper feed direction (in a direction parallel to the platen 103). The saw blade arrangement of the printing pins 106 is employed for increasing printing speed and printing dot density, and decreasing printing time and the heating value of the hammer bank 101. In the example of FIG. 14, a group of 4 printing pins 106 executes dot impact printing for a printing area on the paper 104, as the hammer bank 101 executes the shuttle action. The width of a printing area can be 90 dots, 120 dots, etc., for example, and a plurality of printing pin groups are arranged in the direction parallel to the platen 103. Each printing pin 106 in the printing pin group executes dot impact printing for each dot printing row in the printing area, respectively. In FIG. 14, the first printing pin 106 in the printing pin group (i.e. a printing pin 106 on the right-hand end of the printing pin group) executes dot impact printing for the first row in the printing area. The second and third printing pins 106 in the printing pin group execute dot impact printing for the second and third rows in the printing area. And the fourth printing pin 106 in the printing pin group (i.e. a printing pin 106 on the left-hand end of the printing pin group) executes dot impact printing for the fourth row in the printing area.

Figure 15A:
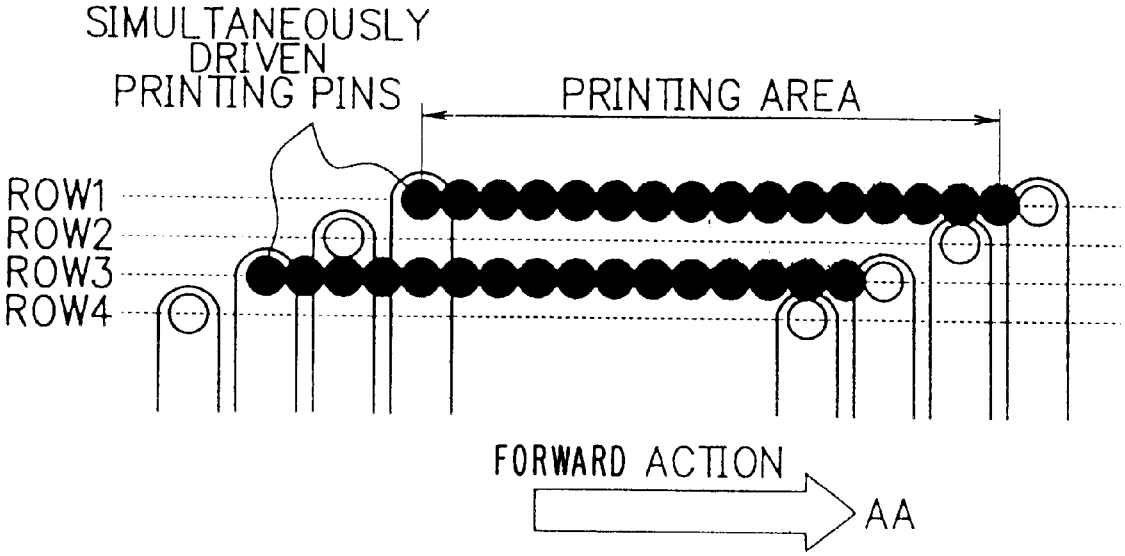
Figure 15B:
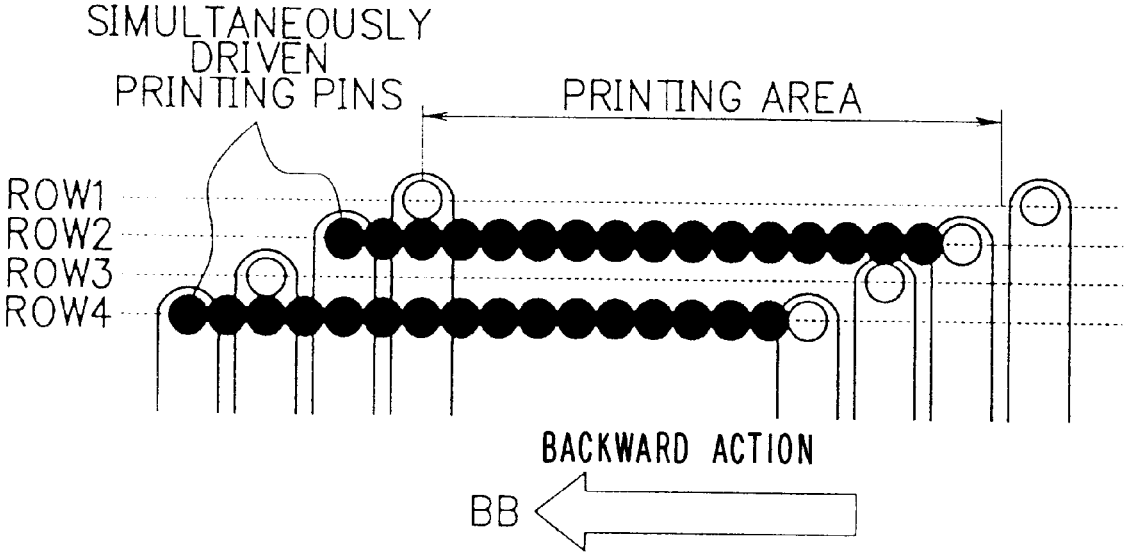

FIGS. 15A and 15B are schematic diagrams showing a skipping printer driving method according to a first embodiment of the present invention. FIG. 15A shows dot impact printing by the printing pins 106 during the forward-action of the hammer bank 101, and FIG. 15B shows dot impact printing by the printing pins 106 during the backward-action of the hammer bank 101. Incidentally, FIGS. 15A and 15B show a case where printing of a solidly shaded (black) pattern is executed by the line dot impact printer. In the forward-action, the first and third printing pins 106 are driven simultaneously so as to execute dot impact printing for the first and third rows, as shown in FIG. 15A. In the backward-action, the second and fourth printing pins 106 are driven simultaneously so as to execute dot impact printing for the second and fourth rows, as shown in FIG. 15B.

Incidentally, while FIGS. 15A and 15B show the case where a solidly shaded (black) pattern is printed on the paper 104, driving of the printing pins 106 (hammer springs 105) is controlled by a driving circuit according to a dot pattern which is outputted by a character generator etc. Therefore, some of the printing pins 106 are not driven and some of the black dots in the figures are not printed, according to the dot pattern.

As described above, in the skipping printer driving method according to the first embodiment of the present invention, odd number printing pins 106 in the printing pin group are driven simultaneously (if necessary for printing the dot pattern) and even number printing pins 106 are not driven in the forward-action of the hammer bank 101, and even number printing pins 106 in the printing pin group are driven simultaneously (if necessary for printing the dot pattern) and odd number printing pins 106 are not driven in the backward-action of the hammer bank 101. Therefore, the distances between simultaneously driven printing pins 106 can be made long, thereby magnetic interference between the printing pins 106 can be reduced, and thus the impact of the printing pins 106 against the ink ribbon 102 and the paper 104 can be increased and the characteristics of the hammer bank 101 such as driving frequency etc. can be improved. Further, the number of simultaneously driven printing pins 106 can be reduced, and thus the load on the driving circuit can be lightened and the noise level of the line dot impact printer can be reduced.

Figure 16A:
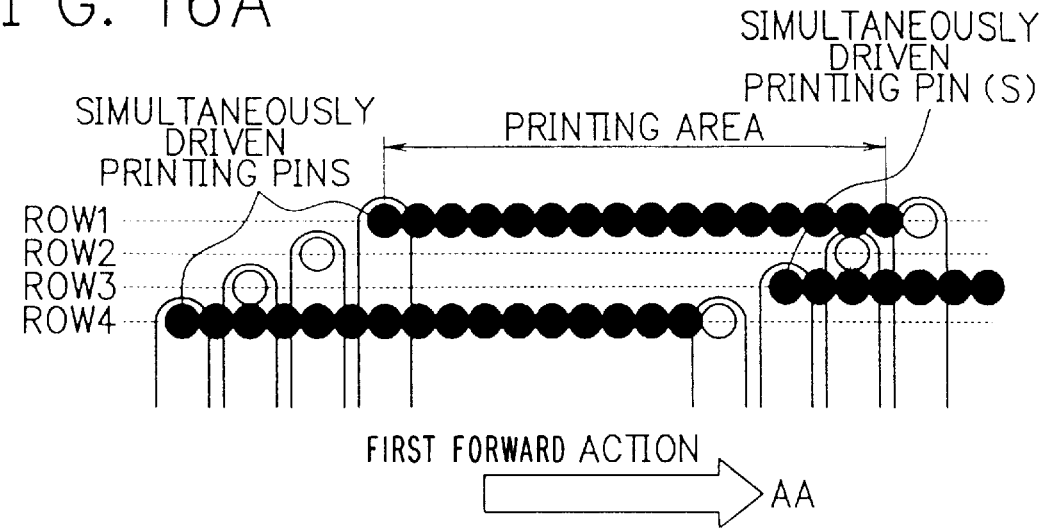
Figure 16B:
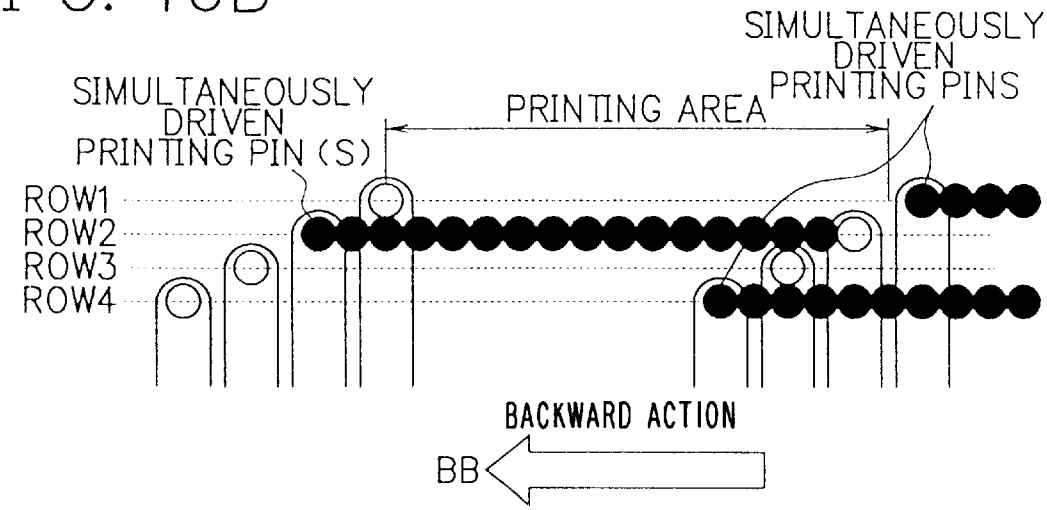
Figure 16C:
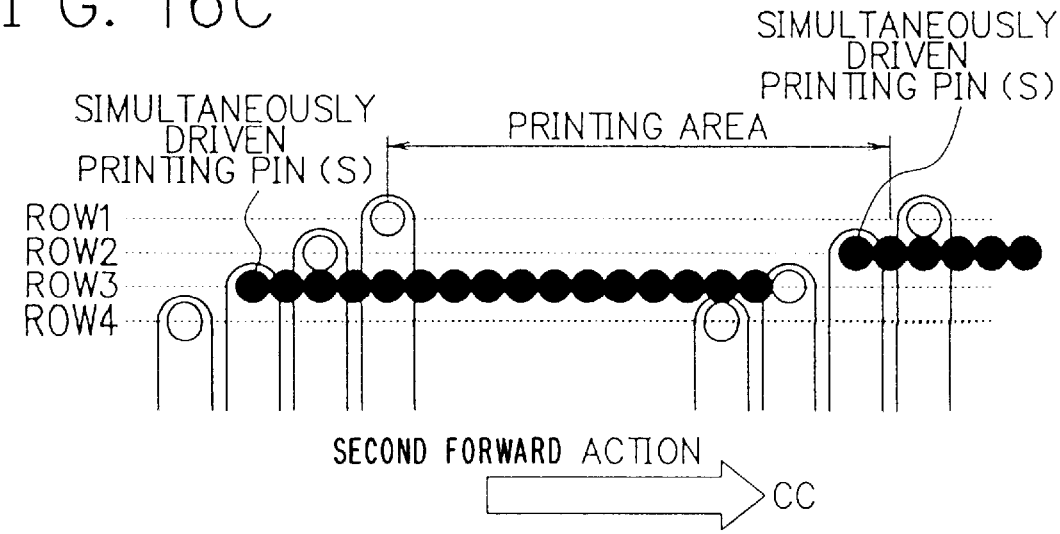

FIGS. 16A through 16C are schematic diagrams showing a skipping printer driving method according to a second embodiment of the present invention. FIG. 16A shows dot impact printing by the printing pins 106 during the first forward-action of the hammer bank 101, FIG. 16B shows dot impact printing by the printing pins 106 during the first backward-action of the hammer bank 101, and FIG. 16C shows dot impact printing by the printing pins 106 during the second forward-action of the hammer bank 101. Incidentally, FIGS. 16A through 16C show a case where printing of a solidly shaded (black) pattern is executed by the line dot impact printer.

In the first forward-action, the first and fourth printing pins 106 in the printing pin group shown on the left-hand side of FIG. 16A are driven simultaneously so as to execute dot impact printing for the first and fourth rows in a corresponding printing area, and the third printing pin 106 in the printing pin group shown on the right-hand side of FIG. 16A is driven (simultaneously with the first and fourth printing pins 106 in the left-hand side printing pin group) so as to execute dot impact printing for the third row in a corresponding printing area, as shown in FIG. 16A.

In the first backward-action, the second printing pin 106 in the printing pin group shown on the left-hand side of FIG. 16B is driven so as to execute dot impact printing for the second row in a corresponding printing area, and the first and fourth printing pins 106 in the printing pin group shown on the right-hand side of FIG. 16B are driven simultaneously (simultaneously with the second printing pin 106 in the left-hand side printing pin group) so as to execute dot impact printing for the first and fourth rows in a corresponding printing area, as shown in FIG. 16B.

In the second forward-action, the third printing pin 106 in the printing pin group shown on the left-hand side of FIG. 16C is driven so as to execute dot impact printing for the third row in a corresponding printing area, and the second printing pin 106 in the printing pin group shown on the right-hand side of FIG. 16C is driven (simultaneously with the third printing pin 106 in the left-hand side printing pin group) so as to execute dot impact printing for the second row in a corresponding printing area, as shown in FIG. 16C.

Incidentally, as mentioned before, while FIGS. 16A through 16C show the case where a solidly shaded (black) pattern is printed on the paper 104, driving of the printing pins 106 (hammer springs 105) is controlled by the driving circuit according to a dot pattern which is outputted by the character generator etc., and thus some of the printing pins 106 are not driven and some of the black dots in the figures are not printed, according to the dot pattern.

To summarize the above operation, driving of the printing pins 106 in each printing pin group is executed by the driving circuit according to the remainder when the printing pin number is divided by 3 (according to the number classes modulo 3).

Concretely, if we describe the printing pin number of a printing pin 106 in the printing pin group as M (M: 1, 2, 3 or 4) and the stroke number of a stroke (a forward-action or a backward-action) of the hammer bank 101 as N (N: 1, 2, 3, 4, . . . ), with regard to the printing pin group shown on the left-hand sides of FIGS. 16A through 16C, the M-th printing pin 106 in the printing pin group is driven (if necessary for printing the dot pattern) during the N-th stroke, if $M \equiv N \pmod 3$. Here, "$M \equiv N \pmod 3$" means that M is congruent (congruous) to N, modulo 3. With regard to the printing pin group shown on the right-hand sides of FIGS. 16A through 16C, the M-th printing pin 106 in the printing pin group is driven (if necessary for printing the dot pattern) during the N-th stroke, if M 30 $1 \equiv N \pmod 3$. With regard to the next (unshown) printing pin group, the M-th printing pin 106 in the printing pin group is driven (if necessary for printing the dot pattern) during the N-th stroke, if $M+2 \equiv N \pmod 3$. In the subsequent printing pin groups, the printing pins 106 are driven (if necessary for printing the dot pattern), similarly to the printing pins 106 in the above printing pin groups. To summarize further, if we describe the serial printing pin number of a printing pin 106 in the printing pin groups as Ms (Ms: 1, 2, 3, 4, . . . ), the Ms-th printing pin 106 in the printing pin groups is driven (if necessary for printing the dot pattern) during the N-th stroke, if $Ms \equiv N \pmod 3$.

As described above, in the skipping printer driving method according to the second embodiment of the present invention, driving of the printing pins 106 in each printing pin group is executed according to the number classes modulo 3 with respect to the printing pin number M.

Therefore, the distances between simultaneously driven printing pins 106 can be made still longer, thereby magnetic interference between the printing pins 106 can be reduced further, and thus the characteristics of the printing pins 106 (hammer springs 105) and the hammer bank 101 can be improved further. Moreover, the number of simultaneously driven printing pins 106 can be reduced further, and thus the load on the driving circuit can be lightened further and the noise level of the line dot impact printer can be reduced further.

Incidentally, while the number of printing pins 106 in each printing pin group was 4 in the above embodiments, of course, the number (L) of printing pins 106 in a printing pin group in the saw blade printing pin arrangement is not limited to 4 and can be varied appropriately.

While the skipping printer driving method according to the number classes modulo 3 has been described in the above second embodiment, it is also possible to employ other similar skipping printer driving methods, such as a skipping printer driving method according to the number classes modulo 2, a skipping printer driving method according to the number classes modulo 4, etc. Such skipping printer driving methods can use either the printing pin number M (M: 1, 2, . . . , L) of a printing pin 106 in each printing pin group or the serial printing pin number Ms (Ms: 1, 2, 3, 4, . . . ) of a printing pin 106 in the printing pin groups of the hammer bank (head bank) 101.

In addition, while the above explanation has been given with regard to a line dot impact printer which executes dot impact printing on paper, the skipping printer driving method according to the embodiments of the present invention can also be applied to other types of printers, such as dot thermal printers for executing dot thermal printing on heat-sensitive paper. In the case of such dot thermal printers etc., the expressions "saw blade printing pin arrangement" and "in the shape of a saw blade" include printing pin arrangement in which printing pins in each printing pin group are arranged vertically, that is, in the paper feed direction.

As set forth hereinabove, by the skipping printer driving method according to the present invention, the distances between simultaneously driven printing pins can be made longer, and thereby magnetic interference between the printing pins can be reduced. By this, the characteristics of the head bank (hammer bank) such as driving frequency etc. can be improved, and the impact of the printing pins of line dot impact printers against the ink ribbon and the paper can be increased. Further, the number of simultaneously driven printing pins can be reduced, and thereby the load on the driving circuit can be lightened and the noise level of line dot impact printers can be reduced.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A method for driving a line dot printer having a head bank which executes shuttle action strokes in a direction perpendicular to a paper feed direction, the head bank having printing pins which are arranged in repeating groups and which form the shape of a saw blade, the groups having L (L: 2, 3, 4 . . . ) printing pins which execute dot printing for the 1st through the L-th dot printing row, wherein the groups are repeated in the direction perpendicular to the paper feed direction, said method comprising the steps of:

assigning one or more of the printing pins in the groups to execute dot printing during each shuttle action stroke by using a number classes modulo with respect to the printing pin number M (M: 1 2, . . . L), the group location, and the shuttle action stroke number N (N: 1, 2, 3 . . . ); and driving each of the printing pins assigned to execute dot printing by a driving circuit so as to execute dot printing of a part of a desired dot pattern to be printed on paper.

2. The method for driving a line dot printer as claimed in claim 1, wherein the step of driving each of the printing pins further comprises selecting one or more dot printing row to be printed in each shuttle action stroke of the head bank.

3. The method for driving a line dot printer as claimed in claim 1, wherein the number classes modulo is 2.

4. The method for driving a line dot printer as claimed in claim 1, wherein the number classes modulo is 3.

5. The method for driving a line dot printer as claimed in claim 1, wherein the number classes modulo is 4.

6. The method for driving a line dot printer as claimed in claim 1, wherein the step of driving each of the printing pins assigned to execute dot printing further comprises dot impact printing on the paper using an ink ribbon by the printing pins assigned to execute dot printing.

7. The method for driving a line dot printer as claimed in claim 1, wherein the step of driving each of the printing pins assigned to execute dot printing further comprises dot thermal printing by the printing pins assigned to execute dot printing, and wherein the paper is heat sensitive.

* * * * *